United States Patent [19]

Koto et al.

[11] Patent Number: 4,998,120

[45] Date of Patent: Mar. 5, 1991

[54] HOT MELT INK JET PRINTING APPARATUS

[75] Inventors: Haruhiko Koto; Yoshinori Miyazawa; Osamu Nakamura; Norihiko Kurashima, all of Nagano, Japan

[73] Assignee: Seiko Epson Corporation, Tokyo, Japan

[21] Appl. No.: 274,873

[22] Filed: Nov. 23, 1988

[30] Foreign Application Priority Data

Apr. 6, 1988 [JP] Japan ..... 63-84302
Apr. 11, 1988 [JP] Japan ..... 63-89654

[51] Int. Cl.[5] ..... B41J 2/045; B41J 2/19
[52] U.S. Cl. ..... 346/140 R
[58] Field of Search ..... 346/140

[56] References Cited

U.S. PATENT DOCUMENTS

| | | | |
|---|---|---|---|
| 4,015,272 | 3/1977 | Yamamori | 346/140 |
| 4,072,959 | 2/1978 | Elmquist | 346/140 |
| 4,312,009 | 1/1982 | Lange | 346/140 |
| 4,383,264 | 5/1983 | Lewis | 346/140 |
| 4,566,018 | 1/1986 | Nilsson . | |
| 4,571,599 | 2/1986 | Rezanka | 346/140 |
| 4,589,000 | 5/1986 | Koto | 346/140 |
| 4,779,099 | 10/1988 | Lewis | 346/140 X |
| 4,785,315 | 11/1988 | McCormick | 346/140 |
| 4,788,556 | 11/1988 | Hoisington | 346/140 X |

FOREIGN PATENT DOCUMENTS

| | | |
|---|---|---|
| 0116466 | 8/1984 | European Pat. Off. . |
| 0131704 | 1/1985 | European Pat. Off. . |
| 0178883 | 4/1986 | European Pat. Off. . |

*Primary Examiner*—Joseph W. Hartary
*Attorney, Agent, or Firm*—Blum Kaplan

[57] ABSTRACT

An ink jet printing apparatus in which the ink jet print head is constructed to eliminate problems caused by air bubbles that can be present in fluid hot-melt ink. The apparatus head includes a heater to melt solid ink or lower the viscosity of high viscosity semi-solid ink and a plurality of ink jet nozzles corresponding to a series of piezoelectric vibrating elements that are positioned so that piezoelectric oscillations propel ink through the nozzles. The vibrators and nozzles are spaced so that if air bubbles are present in the melted ink the bubbles will be induced to travel away from the nozzles by peizoelectrically induced agitation so that they do not interfere with ink jet printing.

16 Claims, 6 Drawing Sheets

FIG. 4
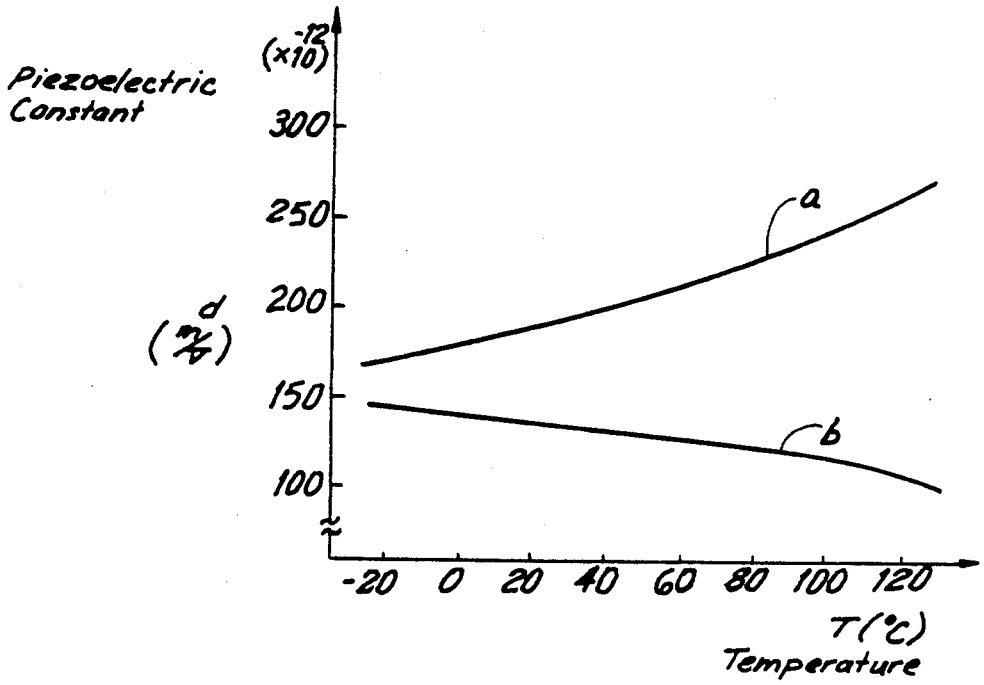
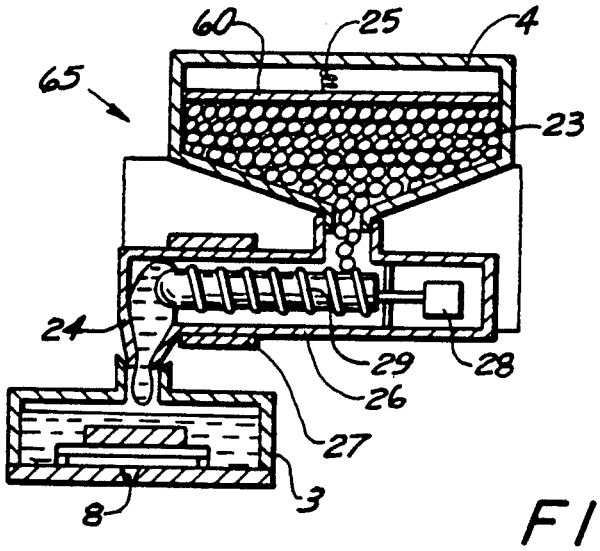
FIG. 6

HOT MELT INK JET PRINTING APPARATUS

BACKGROUND OF THE INVENTION

This invention relates generally to an ink jet printing apparatus and, in particular, to an ink jet print head in which melted ink is ejected through nozzles onto a recording medium such as paper to form characters and images.

An ink jet printer in which ink is ejected from nozzles onto a recording medium to form characters and images is described in U.S. Pat. No. 4,072,959. This patent describes an apparatus in which the outlet ends of a plurality of nozzles are mounted on a nozzle plate and the inlet ends of the nozzles are emersed in ink. The inlets are positioned adjacent to a plurality of corresponding piezoelectric transducers that are also disposed in the ink so that piezoelectrically induced oscillations from the transducers will propel the ink through the nozzles onto a recording medium.

The piezoelectric transducers are formed with vibrators that are arranged and positioned to produce oscillating movement in a direction perpendicular to the plane of the nozzle plate. The ink flow passageways leading to the respective nozzle inlets are short. An ink jet printing apparatus constructed in accordance with the above description can insure enhanced efficiency and stability in propelling ink drops from the nozzles. Only minimal electricity is required to cause the vibrators to sufficiently propel ink through the nozzles for printing.

Conventional ink jet printers of this type have certain limitations and deficiencies, however. For example, because the piezoelectric transducers must be submerged in liquid ink, the ink is typically a nonconductive oil-based ink having organic solvents as main ingredients. Consequently, inadequate printing quality occurs when the ink is propelled onto grainy paper. The ink bleeds into the paper which blurs the print or thins out locally which also adversely affects print quality.

Japanese Laid Open Patent No. 61-98547 describes an ink jet recording apparatus that eliminates inadequacies of ink jet printing with conventional liquid ink. The ink jet printer described in this Japanese patent publication utilizes hot melt ink to enhance printing quality. A critical inadequacy associated with ink jet printing with hot-melt ink is that when the ink changes phase from solid to liquid, air bubbles become trapped in the liquid ink. In extreme cases, the air bubbles can be present to such an extent in critical locations that they absorb the oscillating force from the piezoelectric transducers and prevent proper ink ejection. The configuration of conventional hot-melt ink print heads does not lead to effective dispersion of bubbles.

Conventional ink jet printers therefore have inadequacies due to these shortcomings. Accordingly, it is desirable to provide an improved ink jet printing apparatus which avoids the shortcomings of the prior art and prints clear uniform characters and images on a wide range of recording media.

SUMMARY OF THE INVENTION

Generally speaking, in accordance with the present invention, an ink jet printing apparatus is provided in which the ink jet print head is constructed to eliminate problems caused by air bubbles that can be present in fluid hot-melt ink. The apparatus includes a heater to melt solid ink or lower the viscosity of high viscosity semi-solid ink, and a plurality of ink jet nozzles corresponding to a series of piezoelectric vibrating elements that are positioned so that piezoelectric oscillations propel ink through the nozzles. The vibrators and nozzles are spaced so that if air bubbles are present in the melted ink, the bubbles will be induced to travel away from the nozzles by piezoelectrically induced agitation so that they do not interfere with ink jet printing.

Accordingly, it is an object of the present invention to provide an ink jet printing apparatus in which bubbles in liquified ink do not unintentionally absorb energy for propelling ink.

Another object of the invention is to provide an improved ink jet printing apparatus capable of insuring uniform distribution of temperature in the melted ink and reducing the thermal energy used to heat the ink.

A further object of the invention is to provide an ink jet printing apparatus that can be operated without long delays occurring after periods of non-use.

Still other objects and advantages of the invention will in part be obvious and will in part be apparent from the specification and drawings.

The invention accordingly comprises the features of construction, combinations of elements, and arrangements of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 4 a graph illustrating the variation of piezoelectric constant with temperature for different piezoelectric materials;

FIG. 6 is a cross-sectional view of a solid phase ink supplying device for an ink jet printing apparatus constructed in accordance with the invention;

DETAILED DESCRIPTION OF THE PREFERRED EMBODIMENTS

Figure 1:
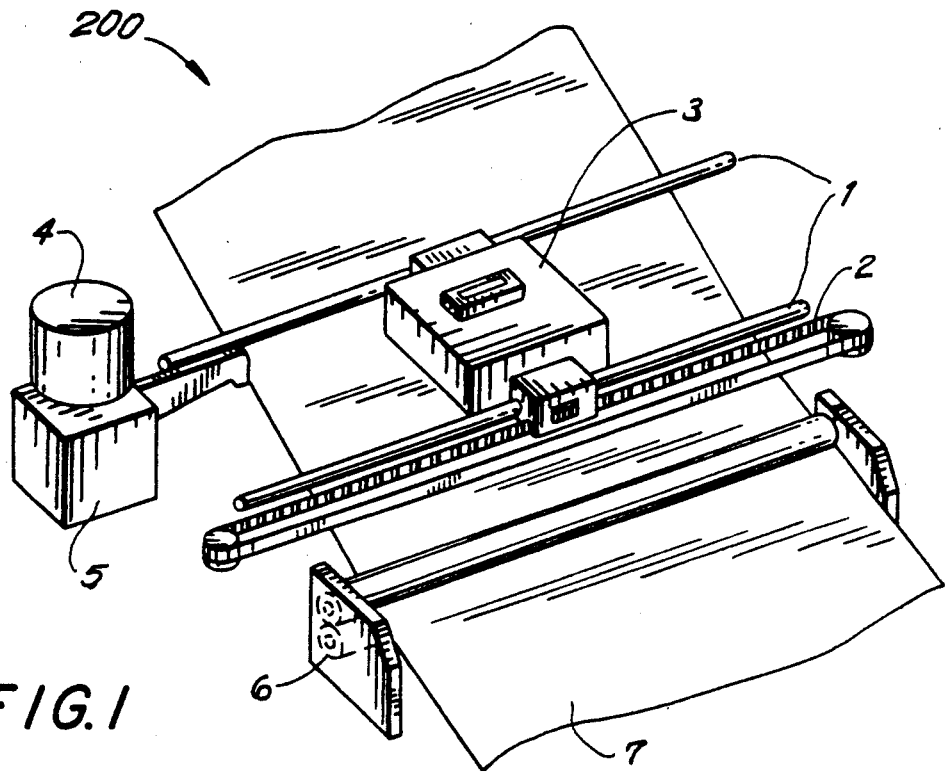
FIG. 1 is a perspective view of an ink jet printing apparatus constructed in accordance with the present invention.

FIG. 1 illustrates an ink jet printing apparatus, generally indicated at 200, constructed in accordance with the present invention. Ink jet printing apparatus 200 includes an ink jet print head 3 mounted on a pair of guide shafts 1 to allow ink jet print head 3 to travel laterally with respect to a recording medium 7, such as recording paper, to print characters and images thereon in reciprocating fashion. A timing belt 2 drives print head 3 along guide shafts 1. A paper feeding system 6 feeds paper longitudinally with respect to print head 3. An ink cartridge 4 mounted on an ink supply system 5 is included in printing apparatus 200 to deliver ink from cartridge 4 to print head 3.

Figure 2:
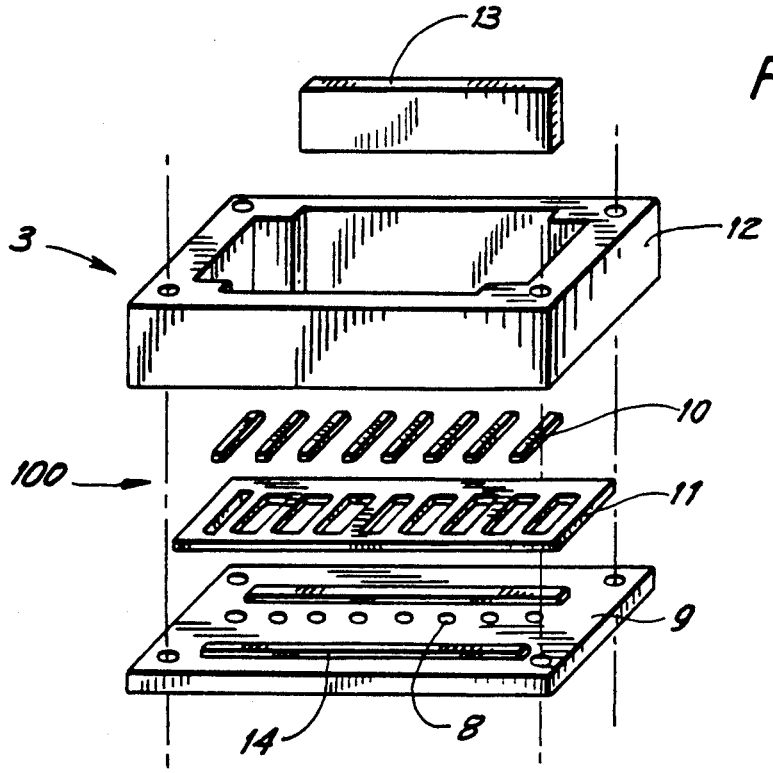
FIG. 2 is an exploded perspective view of a portion of an ink jet print head constructed in accordance with the present invention.

FIG. 2 illustrates the basic components of ink jet print head 3. Print head 3 is formed with a rectangular frame 12. A nozzle plate 9, a piezoelectric transducer 100 and a posistor heater 13 for heating the ink are mounted on frame 12. Nozzle plate 9 includes a plurality of nozzle orifices 8 through which ink is propelled onto recording paper 7. Piezoelectric transducer 100 includes a metal plate 11 and a plurality of piezoelectric elements 10, integral with metal plate 11. Metal plate 11 is preferably about 20–50 μm thick. Frame 12 may preferably be made of a ceramic material having high thermal insulating properties.

Figure 3A:
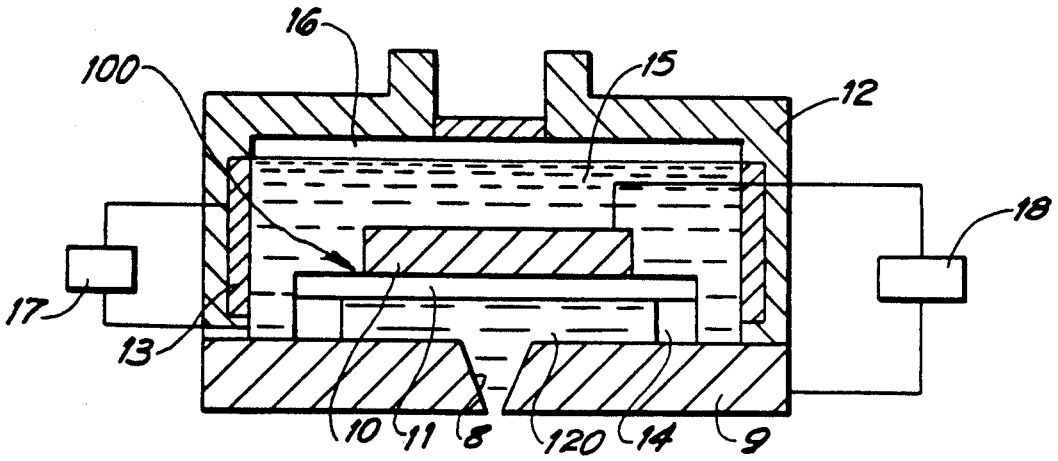
FIGS. 3A and 3B are cross-sectional views at different operating positions of an ink jet print head constructed in accordance with an embodiment of the present invention.
Figure 3B:
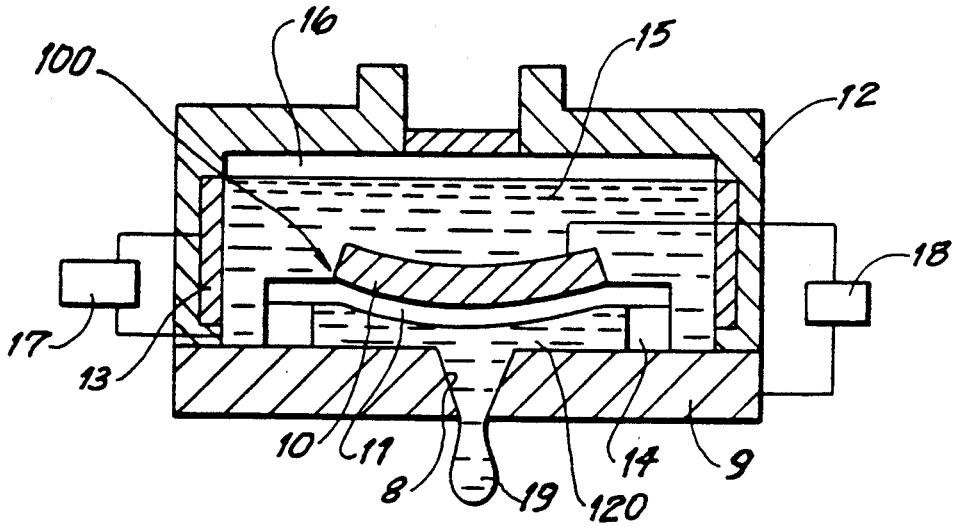

The manner by which piezoelectric transducer 100 propels ink through orifice nozzles 8 is further illustrated in FIGS. 3A and 3B. Nozzle orifices 8 progressively taper to a smaller diameter from their inlet to their outlet end on the outside surface of nozzle plate 9. Piezoelectric transducer 100 is mounted substantially parallel to nozzle plate 9 with piezoelectric elements 10 aligned with corresponding nozzles 8. An ink expulsion gap is maintained intermediate elements 10 and nozzles 8 so that motion from piezoelectric elements 10 towards nozzles 8 will propel ink 15 through nozzles 8 onto a recording medium.

Metal plate 11 acts as a common electrode for all piezoelectric elements 10. Metal plate 11 is electrically wired to one pole of an external power source 18 (FIGS. 3A and 3B). Piezoelectric elements 10 are all connected to an opposite pole of power source 18 so that selectively applied voltage from an external power source will selectively displace piezoelectric elements 10 to propel ink for printing. A heater power source control 17 is also provided (FIGS. 3A and 3B).

The thermal characteristics of piezoelectric elements must be taken into consideration when constructing a piezoelectric transducer for ink jet printing. Each piezoelectric material has a characteristic piezoelectric constant. This parameter helps indicate the material's piezoelectric properties. The piezoelectric constant "d" of a piezoelectric element is expressed by the following equation:

$$d = k\sqrt{\frac{\epsilon T}{Y}} \quad (m/v)$$

wherein: k is an electrical mechanical coupling factor; $\epsilon T$ is the dielectric constant; and Y is Young's modulus.

In general, the dielectric constant ($\epsilon T$) of a piezoelectric element increases with increasing temperature and peaks when the element is heated to its Curie point. The materials for constructing a piezoelectric element determine the electro mechanical coupling factor of the element which denotes different properties thereof. Accordingly, different piezoelectric materials will have different piezoelectric constants denoted by their different mechanical coupling factors.

FIG. 4 is a graph comparing the variation of piezoelectric constant with temperature for different types of piezoelectric materials. Curve "a" illustrates the variation for piezoelectric elements formed of a type "a" material and curve "b" illustrates the variation for piezoelectric elements formed of a type "b" material. The piezoelectric constant for type "a" materials increases with increasing temperature and the piezoelectric constant for type "b" materials decreases with increasing temperature.

The ink in a print head constructed in accordance with the invention is heated to about 120° C. The piezoelectric element should not be exposed to a temperature that is more than about half of its Curie temperature. Accordingly, the piezoelectric element should be made of a material that has a Curie point over about 300° C. Further, piezoelectric elements 10 should be formed of type "a" materials. The piezoelectric constant will increase with temperature and the element will exhibit sufficiently effective displacement when submerged in hot melted ink.

The linear thermal expansion factor for piezoelectric elements 10 and metal plate 11 must be taken into consideration when configuring piezoelectric transducer 100. The piezoelectric elements 10 should preferably have a linear thermal expansion factor ranging from about $1.0\times10^{-6}$ to $3.0\times10^{-6}$ and metal plate 11 should preferably have a linear thermal expansion factor ranging from about $1.0\times10^{-6}$ to $2.0\times10^{-6}$. When piezoelectric transducer 11 is heated from room temperature to about 100° C., piezoelectric elements 10 will bend because they have a different linear thermal expansion factor than metal plate 11. Typically, metal plate 11 expands more than piezoelectric elements 10 so that piezoelectric elements 10 will constantly have a bent shape. The constant bent shape is advantageous in that it determines the direction of displacement and oscillation during piezoelectric expansion and contraction and thus aids in the design of print head 3.

A spacer 14 is positioned intermediate metal plate 11 and nozzle plate 9 to insure than an ink expulsion gap 120 of predetermined size is present between metal plate 11 and nozzles 8. As shown in FIG. 2, spacers 14 can be a pair of bars and their size is critical in determining the length of time that a quantity of ink remains near nozzle orifices 8 and receives piezoelectric pressure from piezoelectric transducer 100. The size of the gap is therefore critical in allowing air bubbles to migrate away from a location between piezoelectric transducer 100 and nozzle orifices 8. The most favorable results have been achieved when spacers 14 have a thickness ranging from about 20 to 50 μm, as this produces optimum conditions for dispersing air bubbles trapped in the ink.

FIGS. 3A and 3B illustrate the basic operation of an ink jet print head 30. Ink jet print head 30, constructed in accordance with an embodiment of the invention, includes a rectangular frame 12 and a heating element 13 mounted within frame 12 to cause a supply of ink 15 in print head 30 to melt into a liquid phase. Frame 12 is constructed and oriented so that any air bubbles which are present as ink 15 is fused into a liquid state can easily rise from the ink expulsion gap 120, past piezoelectric transducer 100 and up into an empty air space 16 defined by the top surface of ink 15 and frame 12.

The ink utilized with a print head constructed in accordance with this embodiment of the invention may be a nonconductive solid-phase ink having a melting point of about 100° C. including stearon, amide stearate and dye. The ink may preferably have a viscosity of 3.5 mPas at 120° C. and a surface tension of 30 dyn/cm.

During printing, the ink is maintained at a constant temperature of about 120° C. in liquid state. By applying voltage across piezoelectric element 10, piezoelectric transducer 100 will displace towards orifice nozzle 8 as shown in FIG. 3B. As piezoelectric transducer 100 displaces towards nozzle 8, a portion of ink 15 intermediate transducer 100 and nozzle plate 9 near nozzle 8 will be propelled from nozzle 8 in the form of an ink drop 19. Ink drop 19 is thereby propelled onto the surface of recording paper and it will immediately solidify to yield clear, sufficiently thick printing.

Figure 5A:
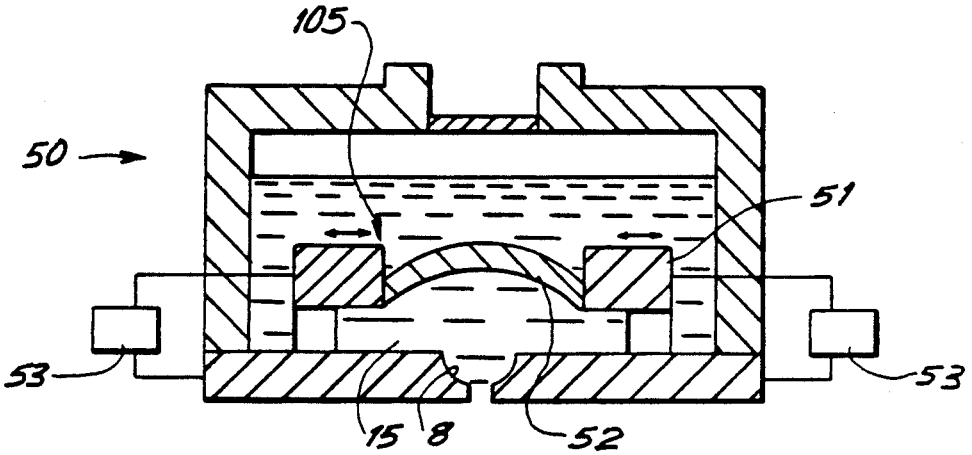
FIGS. 5A and 5B are cross-sectional views at different operating positions of an ink jet print head constructed in accordance with an embodiment of the invention.
Figure 5B:
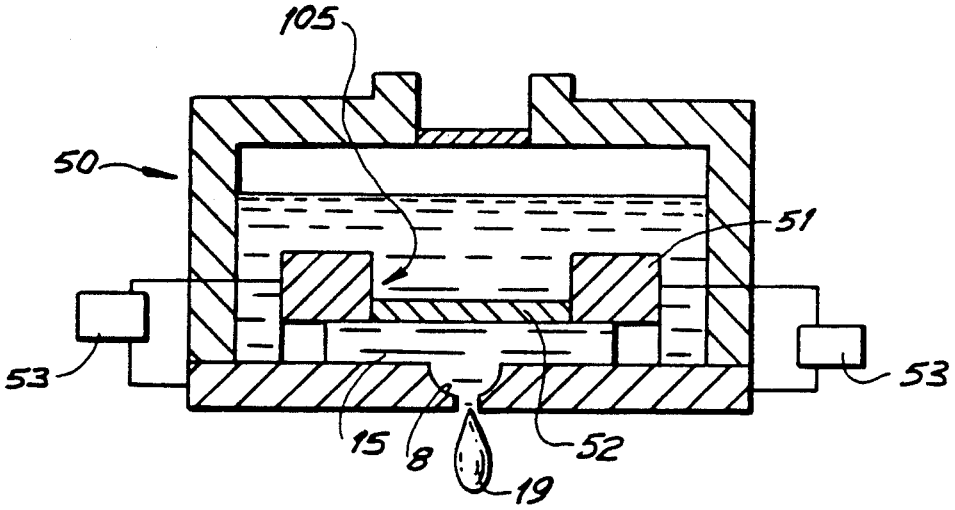

FIGS. 5A and 5B illustrate an alternative embodiment of an ink jet print head 50 constructed in accordance with the invention. Piezoelectric transducer 100 illustrated in FIGS. 3A and 3B had a bimorph structure. A piezoelectric transducer 105 illustrated in FIGS. 5A and 5B is formed with a pair of piezoelectric elements 51 coupled to opposite ends of a metal strip 52. This type of piezoelectric transducer arrangement is designed so that when current is selectively applied to and removed from piezoelectric elements 51 from a current source 53, elements 51 will expand and contract to flex metal strip 52 and exert pressure on a quantity of ink 15 intermediate strip 52 and a nozzle 8 to propel a drop of ink 19 from nozzle 8. As shown in FIG. 5A, metal strip 52 is naturally in an upwardly arched position. When voltage is applied across piezoelectric elements 51 which are fixed to opposite ends of metal strip 11, elements 51 shrink by piezoelectric effect and cause metal strip 52 to straighten as shown in FIG. 5B to force a drop of ink 19 from nozzle 8.

FIG. 6 illustrates an ink supply system 65 for transferring a supply of granular ink 23 to a print head 3, constructed in accordance with an embodiment of the invention in sectional view. Ink supply system 65 includes an ink cartridge 4 for storing granular ink 23 which is solid at room temperature. A spring 25 is mounted in cartridge 4 to exert pressure on a piston 60 to force ink 23 towards a spiral pushing rod 29 mounted in a cylinder 26. A small motor 28 is drivingly coupled to spiral rod 29 to rotate rod 29 and transport ink 23 through cylinder 26 into ink head 3.

A heater 27 is disposed on an outside wall of cylinder 26 to heat ink 23 in cylinder 26. Further, spiral rod 29 rotates in ink 23 which heats ink 23 by friction. This will raise the temperature of ink 23 which will begin to melt. By taking advantage of this frictional heating, the energy required by heater 27 is decreased and energy is utilized more efficiently.

In operation, ink supply system 65 transports a continuous supply of sufficiently melted ink 23 to print head 3 in a beneficial manner. An outlet valve 24 at the outlet of cylinder 26 is normally closed. It is only open when ink head 3 is to be replenished with fresh ink. A filter is preferably installed at outlet valve 2 to prevent dust and dirt from entering into print head 3.

Figure 7:
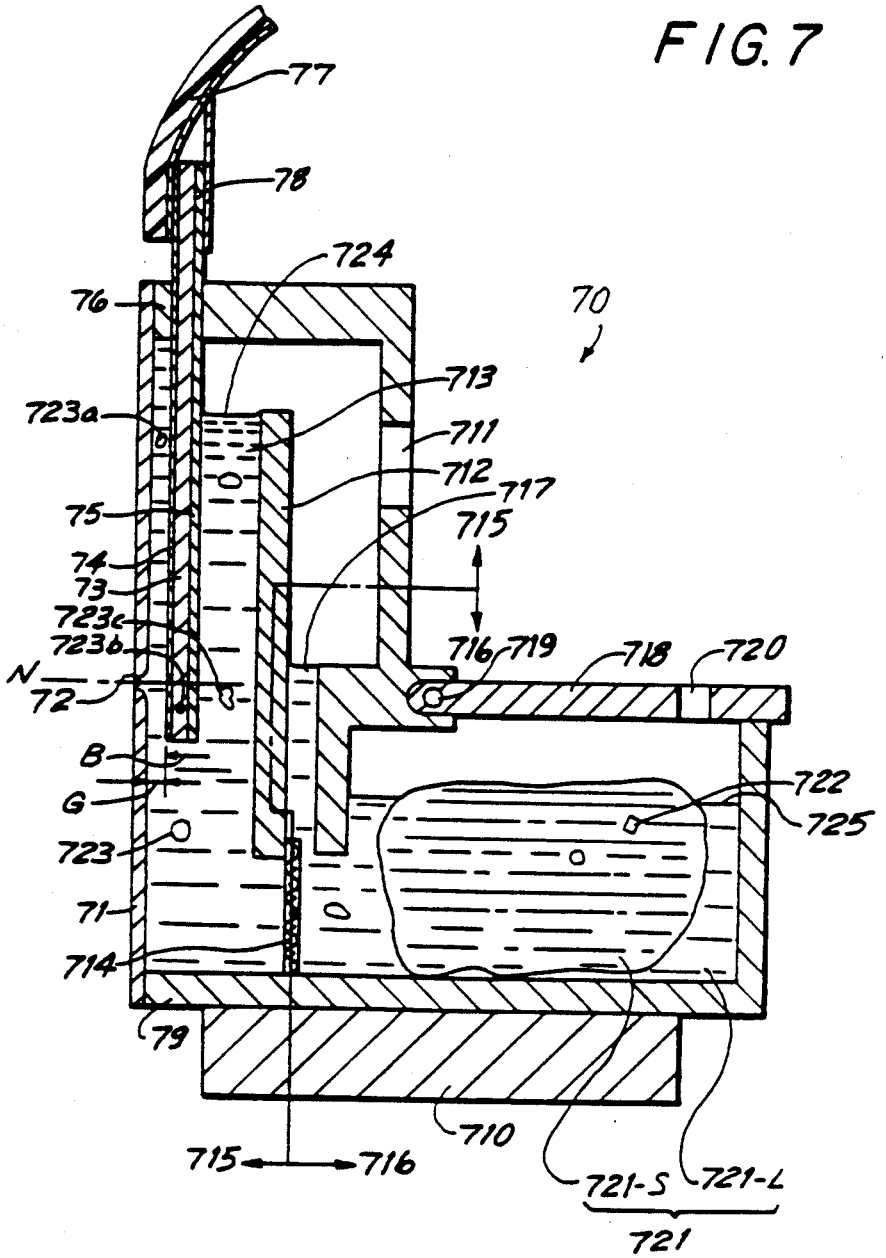
FIG. 7 is a cross-sectional view of an ink jet print head constructed in accordance with an embodiment of the invention.

FIG. 7 illustrates an ink jet print head 70 constructed in accordance with another embodiment of the present invention. Print head 70 is formed with a rectangular frame 79 and a nozzle plate 71 mounted at a front side of frame 79. Nozzle plate 71 includes a plurality of nozzle orifices 72 bored therethrough. Nozzle plate 71 may preferably be formed by electroforming nickel.

A plurality of piezoelectric elements 73 are mounted in frame 79, behind nozzle plate 71 and each element 73 faces a nozzle 72. An ink expulsion gap G of selected dimension is maintained between nozzles 72 and element 73. Piezoelectric elements 73 may preferably be formed of 100 μm thick PZT. Each piezoelectric element 73 is laminated with an electrode 74 on its front surface that faces nozzle 72. Electrodes 74 may preferably be formed of nickel, having a thickness ranging from about 0.5 to 1.5 μm. The rear surface of each element 73 is plated with a vibration plate 75 which may preferably be formed of a 10 to 30 μm thick layer of nickel. The combination of piezoelectric elements 73, electrode 74 and vibration plate 75 forms a piezoelectric transducer. A thin metal spacer 76 is secured to an inner surface of nozzle plate 71 to maintain piezoelectric elements 73 a specified distance from plate 71 to define the dimensions of ink expulsion gap G therebetween.

Frame 79 is preferably made of diecast aluminum which conducts heat well. A posistor heater 710 is mounted on an outside bottom side of frame 79. A vent hole 711 is formed in an upper portion of frame 79 to allow the venting of gasses. Print head 70 further includes a flexible printed circuit (FPC) 77. FPC 77 includes an electrically conducting layer disposed on a flexible base. The flexible base can be formed of plastic, the conducting layer can be formed of copper and an insulating film can be disposed on the conducting layer. FPC 77 is electrically connected to each electrode 74 and to common electrode 78 to selectively drive piezoelectric elements 73.

Frame 79 of ink jet print head 720 is divided into an ink jet section 715 and an ink reservoir section 716. An ink supply holding member 712 is provided within frame 79 behind the piezoelectric transducer to define an ink holding gap 713 intermediate member 712 and nozzle plate 71 and to separate melted ink in ink jet head section 715 from ink stored in ink reservoir section 16. A filter 714, preferably formed of stainless steel mesh is included between the bottom of ink supply holding member 712 and the inner bottom surface of frame 79 to allow ink to pass from ink reservoir section 716 into ink jet section 715. An ink return passage 717 is provided intermediate frame 79 and ink supply holding member 712 so that if ink overflows from ink jet head section 715, out of holding gap 713, over holding member 712, it will return to ink reservoir section 716. A lid 718 is pivotally mounted on reservoir section 716 of frame 79 by an axle 719. A vent hole 720 is provided in lid 718 to ventilate gases from within frame 79. Lid 718 can be pivoted open when additional ink is needed to fill reservoir 716.

Ink supply holding member 712 is positioned parallel with plate 71 and piezoelectric elements 73 are interposed therebetween. Member 712 is spaced 0.3 to 1.5 mm from plate 71 to define the dimensions of ink holding gap 713. Ink return passage 717 is formed intermediate frame 79 and a rear surface of ink supply member 712. Ink from reservoir section 716 will flow through filter 714 and up into gap 713 by capillary action. If ink overflows over ink supply member 712, it will return to ink reservoir section 716 through ink passage return 717. The distance from ink supply holding member 712 and frame 79 should be less than 1 mm so that liquid ink in return passage 717 will rise to a predetermined height by capillary action and form a meniscus.

To operate ink jet print head 70, a power switch is activated to energize heater 710 which begins warming the bottom of frame 79. Heat is transferred through frame 79 and heats nozzle plate 71, filter 714 and ink supply holding member 712. When the temperature of these components reaches about 120° C., all of the ink 721 that is intermediate plate 71 and holding member 712 as well as a portion of solid ink 721-S in ink reservoir section 716 that is near the bottom of frame 79 and adjacent filter 714 begins to melt into liquid phase ink 721-L. As solid-phase ink 721-S begins to melt, voids 722 that are present in solid ink 721-S become gas bubbles 723.

A required quantity of liquid phase ink 21-L is obtained within about 10 to 30 seconds from the start of heating. To initiate printing, a control circuit is activated and applies voltage to the piezoelectric transducer and selected piezoelectric elements 73 become displaced in the direction of arrow B by the piezoelectric effect. When piezoelectric element 73 bends sufficiently, pressure is exerted on the ink within expulsion gap G and a drop of ink will be expelled through nozzle 72 onto the surface of recording paper where it will solidify in the form of characters or images.

As ink is expelled through nozzles 72, ink jet section 715 is replenished with liquid ink 721-L from ink reservoir 716 through filter 714. As ink flows from reservoir section 716 to ink jet section 715, the level of ink 725 in reservoir section 716 decreases. However, liquid ink 721-L within expulsion gap G or holding gap 713 are maintained at a sufficient predetermined height due to capillary action. As ink flows from reservoir section 716, solid ink 721-S Which had been floating in liquid ink 721-L comes closer to heater 710 and is liquified. As print head 770 is agitated during printing, ink within holding gap 713 can spill over holding member 712 into return passage 717. However, return passage 717 maintains a proper height due to capillary action.

When ink in reservoir section 716 is depleted and the height of meniscus 724 in holding gap 713 falls below the level of orifice nozzle 72, printing will stop. To resume printing, lid 718 is opened and additional solid ink is placed in reservoir 716. The new solid ink 721-S is melted by heater 710 into liquid ink 721-L. It will flow through filter 714 into ink jet section 715 and the proper height of ink in expulsion gap G and holding gap 713 will be reachieved by capillary action.

When power to print head 70 is turned off, the entire print head begins to cool and liquid ink 721-L in ink jet section 715 begins to cool into solid ink 721-S. During solidification, the volume of the ink is reduced by about 20% and voids are formed within ink 722-S. Initially, these voids are low pressure voids but eventually, external air flows into the voids until they reach atmosphere pressure. These voids will become air bubbles 723 when printing begins again.

As a result of successive oscillations of piezoelectric element 73, liquid phase ink 721-L present between piezoelectric element 73 and ink supply holding member 712 is agitated violently. This induces a plurality of air bubbles **723*c* that might be present in ink 721-L in two regions to move upwardly to be released at a meniscus 724 at the surface of ink within gap 713. The released air can then escape from frame 79 through vent hole 711**.

Air bubbles can also be present between nozzle plate 71 and piezoelectric elements 73. A remote plurality of bubbles **723*a* hovering at positions remote from nozzles 72 are not likely to be moved because they are exposed to minimal piezoelectric agitation from element 73 and because they are confined in a narrow space. However, because they are remote, bubbles 723*a* have little effect on the ejection of ink through nozzles 72**.

A plurality of potentially interfering bubbles **723*b* can be present close to nozzle orifice 72. However, potentially interfering bubbles 723*b* are subjected to maximum piezoelectric agitation which induces near bubbles 723*b*** to move to less agitated regions where they will not interfere with the operation of the ink jet printer.

Figure 8:
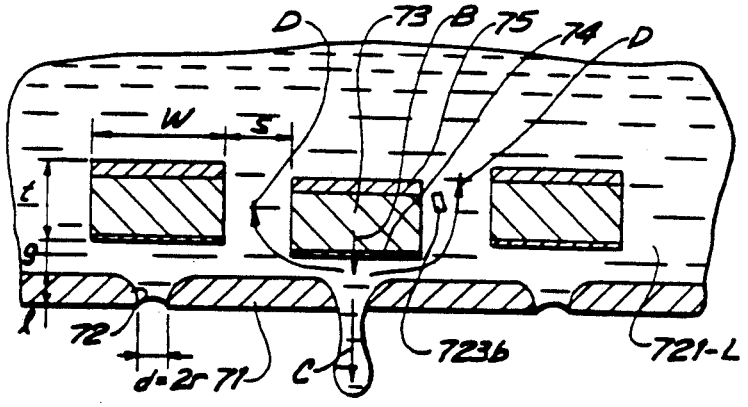
FIG. 8 is a cross-sectional view of an enlarged portion of FIG. 7.

FIG. 8 illustrates the behavior of air bubbles **723*b* near nozzles 72. FIG. 8 is a bottom sectional view of FIG. 7 taken through line N. When a piezoelectric element 73' is selectively piezoelectrically deformed towards nozzle 72 in the direction of arrow B, force is exerted on liquid ink 721-L causing it to be propelled through nozzle 72 in the direction of arrow C. Liquid ink 721-L that is not expelled is forced in the direction of arrows D into ink holding gap 713 behind the piezoelectric transducer. As the proportion of ink 721-L forced in the direction of arrows D increases in relation to the ink 721-1 propelled through nozzle 72, the farther bubbles 723*b* are forced from the vicinity of nozzle 72 which minimizes their adverse effect on ink propulsion. Accordingly, ink jet section 715 should be constructed to reasonably maximize the proportion of ink forced back into holding gap 713** to minimize the adverse effect of bubbles.

The quantity of ink 721-L forced back into holding gap 713 can be denoted $Q_b$ and the amount 721-L ejected can be denoted $Q_m$. Their ratio, $Q_b/Q_m$ can be denoted K. When an ink jet head is designed so that the value of K exceeds 3, bubbles **723*b* are efficiently kept away from the vicinity of nozzle 72. However, if the value of K is in the range of about 3 to 10, some bubbles 723, trapped in the ink drop being ejected might be propelled through nozzle 72. This leads to printing defects. If a print head is designed so that K is equal to or greater than 10, bubbles 723 will effectively be kept away from nozzles 72** to increase printing stability.

In theory, the ratio K is inversely proportional to the ratio of fluid impedance for the mass of ink moving away from nozzle 72 to the mass being ejected through nozzle 72. The magnitude of fluid impedance for ink is determined by the inertia and viscous resistance of the ink. Accordingly, desired results can be obtained by selecting a ratio of inertia and viscous resistance so that the predetermined value is met or exceeded. For higher frequencies of piezoelectric transducer vibration, the effect of ink inertia tends to be greater than the effect of viscous resistance. However, for lower frequencies, the viscous resistance has the greater effect.

Viscous resistance and inertia can be defined as follows:

$$\text{viscous resistance} \propto \frac{\text{length of flow passageway}}{(\text{cross sectional area of flow passageway})^2}$$

$$\text{inertia} \propto \frac{\text{length of flow passageway}}{\text{cross sectional area of flow passageway}}$$

It has been determined that the ratio of viscous resistance ($K_r$) and the ratio of inertia ($K_i$) can be computed by the following formulas:

$$K_r \approx 4\left(\frac{w}{2\,(g \cdot w)^2} + \frac{t}{(s \cdot w)^2}\right) \div \frac{1}{(\pi r^2)^2} \quad (1)$$

$$K_i \approx 4\left(\frac{1}{2g} + \frac{t}{s \cdot w}\right) \div \left(\frac{1}{\pi r^2}\right) \quad (2)$$

wherein:

w is the width of a piezoelectric element;

g is the distance between a piezoelectric element and a nozzle plate;

t is the total thickness of a piezoelectric element;

s is the distance between piezoelectric elements;

l is the axial length of an orifice nozzle; and r is the radius of an orifice nozzle.

Both $K_i$ and $K_r$ should be no less than the desired minimum value for K. If the value of K is greater than or equal to 3, both $K_r$ and $K_i$ must be greater than or equal to 3. Values for $K_r$ and $K_i$ computed by formulas (1) and (2) are 6.2 and 3.5 when a print head has the following dimensions wherein d is the diameter of an orifice nozzle:

| | |
|---|---|
| l = 50 μm | t = 50 μm |
| d = 60 μm | g = 50 μm |
| w = 100 μm | s = 50 μm |

The print head having these dimensions was operated and air bubbles did not adversely affect print quality. Accordingly, a print head having the above dimensions will have a proper ratio of $Q_b/Q_m$.

For comparison, tests were performed on configurations whose dimensions yielded values of $K_r$ and $K_i$ that were smaller than 3. For example, a print head was constructed with components having dimensions: d=100 μm, g=10 μm, s=50 μm to yield a value of 0.06 for $K_r$ and 0.36 for $K_i$. It was confirmed that air bubbles within the ink interfered with proper printing for print head configurations yielding values of $K_r$ and $K_i$ that are less than 3.

Although large values of K will increase the extent that bubbles 723 are kept away from the vicinity of nozzles 72, excessively large K's will adversely affect ink ejection through nozzles 72. For example, the voltage will have to be increased to effectively drive the piezoelectric transducer with sufficient force to properly expel a sufficient quantity of ink. It was determined that desirable results were obtained when the value for K is below 100, and preferably below 50.

The operation of ink jet print heads has been described with respect to normally solid hot-melt ink. However, the above description is equally applicable to semi-solid inks having high viscosities at room temperature and low, fluid-like viscosities at elevated temperatures. As with hot melt solid inks, when high viscosity inks in an ink jet print head are heated to about 100° C., air present in the semi-sold ink will develop into air bubbles as high temperatures decrease the gas solubility and increase gas volume. The benefits of the present invention are equally applicable to constructions which utilize high viscosity inks that are semi-solid at high temperatures.

Modifications can be made in the previously described ink jet print heads. For example, vent hole 711 of ink jet print head 70 is designed to remain open. However, the print head can be designed with a vent hole that is normally closed and is only opened to the atmosphere when necessary. Alternatively, the print head may be constructed so that vent hole 711 is entirely eliminated and meniscus 724 of ink in holding gap 713 is directly exposed to the atmosphere. In another embodiment of the invention, vent hole 711 may be eliminated so that menisous 724 at the surface of the liquid ink 721-L within holding gap 713 is exposed directly to the atmosphere.

Ink 21-L within ink jet section 715 of print head 70 forms a meniscus 24 between piezoelectric elements 73 and ink supply holding member 712. Alternatively, member 712 may be longer and extend into a higher portion of frame 79. This will raise ink 721-L higher by capillary action and piezoelectric elements 73 will be submerged. A meniscus would be formed between member 712 and an opposing inner front wall of frame 79.

Ink holding member 712 is spaced no more than 1.5 mm from nozzle plate 71 in print head 70. As the ink solidifies, the stress generated from solidification does not concentrate on elements 73. Ink 721 has about 10 to 100 times greater thermal expansion and construction than elements 73, nozzle plate 71 and holding member 712 which are all similar in thermal expansion. The selected spacing reduces the concentration of stress on elements 73 during solidification. If the spacing is greater than about 3 mm, the ink could exert sufficient stress to damage or shorten the life of elements 73 during solidification.

Figure 9:
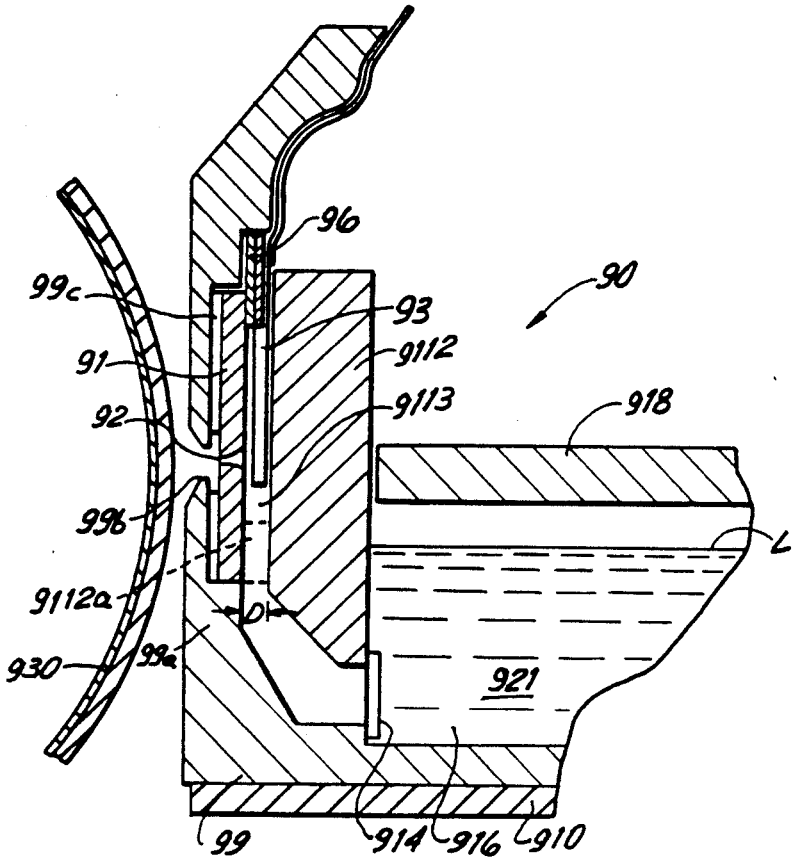
FIG. 9 is a cross-sectional view of an ink jet print head constructed in accordance with an embodiment of the invention.

FIG. 9 illustrates print head 90, constructed in accordance with an alternative embodiment of the invention. Ink jet print head 90 is formed with a casing 99 and a posistor heater 910 mounted on an outer bottom surface of frame 99. Frame 99 includes an ink reservoir 916 covered with a lid 918. Ink 921 within reservoir 916 flows into an ink jet section 915 through a filter 914.

Ink jet section 915 includes a nozzle plate 91 having a plurality of orifice nozzles 92 bored therethrough. Casing 99 is preferably a metal material that conducts heat well. Nozzle plate 91 is mounted in a front region of casing 99 behind a face **99*a*. Face 99*a* is formed unitarily with casing 99 and positioned opposite a platen 930. Face 99*a* includes a plurality of ink jet orifices 99*b* that are formed in the direction of the axis of platen 930. A spacing member 99*c* is positioned intermediate face 99*a* and nozzle plate 91. A piezoelectric element 93 is mounted behind nozzle plate 91 and is separated from nozzle plate 91 by a second spacer 96**.

Figure 10:
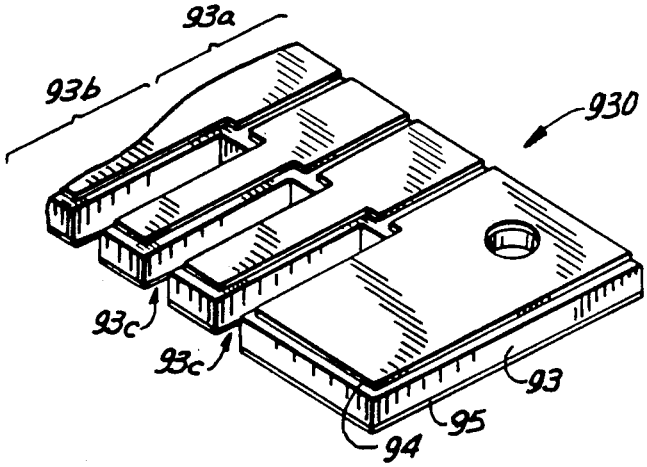
FIG. 10 is a perspective view of a piezoelectric transducer included in an ink jet print head constructed in accordance with the invention.

A piezoelectric transducer 930 constructed in accordance with the invention is illustrated in perspective view in FIG. 10. Piezoelectric transducer 930 includes piezoelectric element 93, which is preferably formed of PZT. A common electrode 95 is laminated on one surface of element 93 and a pattern electrode 94 is plated on the opposite surface of element 93. Element 93 contains a plurality of notches **93*c* cut out along one side to form a plurality of vibrators 93*b*. Cutouts 93*c* are spaced the same distance apart as are nozzles 92 so that a vibrator 93*b* corresponds to each nozzle 92 of nozzle plate 91 within casing 99**.

Piezoelectric transducer 930 further includes a supportive base section **93*a* extending along the side that does not include vibrators 93*b***. Piezoelectric transducer 930 is mounted in casing 99 with the ends of vibrators 93*b* positioned opposite nozzles 92 and support base portion 93*a* positioned above nozzle orifices 92. Accordingly, most of the piezoelectric transducer, including support base portion 93*a* is exposed above the level of ink.

Casing 99 includes a divider 9112, positioned behind piezoelectric transducer 930. The rear portion of casing 99 and the rear surface of divider 9112 define an ink reservoir 916. Divider 9112 includes a protrusion 9112*a* which abuts and supports nozzle plate 1 from behind. Protrusion 9112*a* has a width D to maintain nozzle plate 91 about 0.2 to 2.0 mm from divider 9112. The dimensions of protrusion 9112*a* is selected so that ink within an ink chamber 9113 defined by divider 9112 and nozzle plate 91 will rise by capillary action to a level above the center of nozzle orifices 92. The width of ink chamber 9113 must be small enough so that the ink level will not fluctuate appreciably when ink jet print head 90 is vibrated during printing. HoWever, chamber 9113 must be wide enough to allow air bubbles to readily move away from the vicinity of nozzles 92 and to insure that ink will flow into chamber 9113 at a satisfactory rate.

A lid 918 is provided o casing 99 to releasably seal ink reservoir section 916. Lid 918 is located at a level below nozzles 92 so that the liquified ink level L within reservoir 916 remains below nozzles 92. A sensor can be provided within reservoir 916 to detect when ink level L drops below a predetermined height and a mechanism can be included to insure that a fresh supply of solid ink is transferred into reservoir 916 when ink level L becomes too low, but not higher than the lowest nozzles 92. A filter 914 is provided in the interface connecting ink reservoir 916 and ink chamber 9113 to prevent dust and dirt from entering chamber 9113.

During operation of ink jet head 99, a heater 910, mounted below and outside casing 99 is energized to heat casing 99. Casing 99 is preferably made of a material having a high heat transfer property so that casing 99 will become uniformly heated. Solid ink within reservoir 916 is liquified by the heat generated by heater 910 at the bottom of casing 99. Convection within molten ink 921 helps warm the entire casing 99. After casing 99 is heated to a sufficiently high temperature, the flow of liquified ink 921 through the passage into ink chamber 9113 is facilitated. Solid ink within the narrow space of ink chamber 9113 becomes liquified so that it can be ejected through nozzles 92 during printing.

When a selected group of electrodes 94 is energized, corresponding to a pattern or image to be printed, the corresponding vibrator 93*b* in piezoelectric transducer 930 which is positioned primarily above the ink level, displaces towards nozzle 92. Ink between nozzle plate 91 and divider plate 9112 is pressurized by oscillating vibrators 93*b* and drops of ink are thereby propelled through nozzle 92, opposite oscillating vibrator 93*b* so that ink is jetted onto a sheet of paper 931 on a platen 930.

When printing is completed and power is turned off, casing 99 cools and liquid ink in chamber 9113 solidifies quickly because of the small volume of chamber 9113 and thereby holds vibrators 93*b* stationary in solidified ink 921. Because vibrators 93*b* are quickly held stationary in the solidified ink, they are protected from physical deformation which could occur from pressures exerted when the remaining ink 921 later solidifies.

Accordingly, ink jet print heads constructed in accordance with the invention eliminate deficiencies of prior art ink jet print heads because they eliminate the deleterious effects of air bubbles trapped in liquified ink by effectively inducing bubbles to disperse. Ink jet printing apparatuses including ink jet print heads constructed in accordance with the invention can produce excellent print quality with hot melt solid or semi-solid ink.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all the generic and specific features of the invention herein described and all statements of the scope of the invention which, as a matter of language, might be said to fall therebetween.

What is claimed is:

1. An ink jet printing apparatus for printing with an ink that is normally in a solid phase or of high viscosity at room temperature and in a liquid phase at elevated temperatures, comprising a print head including a plurality of nozzles through which ink is selectively ejected, transducer means for selectively ejecting ink out of said nozzles supported on said print head in a position to be immersed in ink at a predetermined distance from said nozzles to define a narrow gap and liquid ink is to be present in the gap and the print head includes a vent hold above the gap and in communication with both said ink and the atmosphere during printing, the gap configured and dimensioned to permit air bubbles in said ink to pass away from a position intermediate said nozzles and said transducer means to exit from the vent hole, the transducer means including a piezoelectric vibrator including a piezoelectric element formed of a material whose piezoelectric modules increases with increasing temperature, heating means in said print head for heating said ink to lower the viscosity thereof, and an ink chamber formed in said head adapted to store ink therein.

2. The ink jet printing apparatus of claim 1, wherein said ink chamber includes an area for receiving said air bubbles from said ink.

3. The ink jet printing apparatus of claim 1, wherein said heating means and said transducer means are both supported within said ink chamber.

4. The ink jet printing apparatus of claim 3, wherein said ink chamber is formed of an insulating material.

5. The ink jet printing apparatus of claim 1, wherein said piezoelectric vibrator is formed of a piezoelectric element and a metal film formed integrally with the piezoelectric element, and the piezoelectric element and the metal film have different coefficients of thermal expansion.

6. The ink jet printing apparatus of claim 1, wherein the gap is between about 20 to 50 μm wide.

7. An ink jet printing apparatus for printing with an ink that is normally in a solid phase or of high viscosity at room temperature, comprising a print head having a vent in an upper portion thereof and configured to form an air space below the vent and including a nozzle plate formed with a plurality of nozzles therein through which ink is selectively ejected, transducer means including piezoelectric transducers for selectively ejecting ink out of said nozzles supported on said print head at a predetermined distance from said nozzle plate to define a gap of such minimum dimension and the print head configured to permit air bubbles in said ink to pass intermediate said nozzle plate and said piezoelectric transducers to the air space below the vent and to exit through the vent, heating means in said print head for heating said ink to lower the viscosity thereof, an ink chamber formed in said print head adapted to store ink therein, and an ink plate positioned in said ink chamber and spaced from said nozzle plate to define an elongated narrow space that permits ink in said narrow space to rise above the level of said nozzles by capillary action and the width of the piezoelectric transducers, the distance between the piezoelectric transducers and the nozzle plate, the thickness of the piezoelectric transducers, the axial length of the nozzles and the radius of the nozzles are all dimensional such that the ratio of the amount of ink forced back into the space between the ink plate and the piezoelectric transducers to the amount of ink ejected through a nozzle during printing is greater than 3 and less than 100.

8. The ink jet printing apparatus as claimed in claim 7, wherein said ink plate is made of a material having a high heat transfer property.

9. The ink jet printing apparatus as claimed in claim 7, wherein said ink chamber is divided into a print head section and an ink reservoir section by said ink plate, the ink reservoir section of said ink chamber including an opening for replenishing ink.

10. The ink jet printing apparatus as claimed in claim 9, wherein said ink reservoir section of said ink chamber includes a lid for covering said opening.

11. The ink jet printing apparatus as claimed in claim 9, wherein said ink plate defines an ink return passage intermediate said plate and said ink reservoir section of said ink chamber, said return passage being in fluid communication with said ink reservoir section, said return passage being narrow such that ink in said passage forms a meniscus by capillary action.

12. The ink jet printing apparatus as claimed in claim 9, wherein said ink plate defines a passage at the lower end thereof which establishes fluid communication between the print head section and ink reservoir section in said ink chamber, said passage having a filter positioned therein.

13. The ink jet printing apparatus as claimed in claim 7, wherein said transducer means includes a piezoelectric vibrator divided into a plurality of vibrator elements positioned proximate said nozzles.

14. The ink jet printing apparatus as claimed in claim 13, wherein said transducer means includes a support base portion for coupling said plurality of vibrators, said transducer means being positioned such that said support base portion is not immersed in said ink, and said plurality of vibrators positioned opposite said nozzles.

15. The ink jet printing apparatus of claim 7, wherein the printer is constructed so that the ratio of the amount of ink forced back to the space to the amount of ink ejected during printing is greater than 10 and less than 50.

16. The ink jet printing apparatus of claim 7, wherein the ink plate is positioned from 0.3 to 1.5 mm from the nozzles.

* * * * *